US005643148A

United States Patent [19]

Naville

[11] Patent Number: 5,643,148

[45] Date of Patent: Jul. 1, 1997

[54] SPORTING AND EXERCISING DEVICE HAVING A FOOT RECEIVING PORTION AND AN ANTICOLLAPSE SPRING PORTION

[75] Inventor: Denis Naville, Genève, Switzerland

[73] Assignee: Denis Naville S.A., Geneva, Switzerland

[21] Appl. No.: 678,508

[22] Filed: Jul. 9, 1996

[30] Foreign Application Priority Data

Jan. 10, 1996 [CA] Canada ..... 2166939

[51] Int. Cl.[6] ..... A63B 25/10

[52] U.S. Cl. ..... 482/77; 482/79; 482/124

[58] Field of Search ..... 482/77, 79, 121, 482/122, 124

[56] References Cited

U.S. PATENT DOCUMENTS

| | | |
|---|---|---|
| 1,638,350 | 8/1927 | Long . |
| 3,219,358 | 11/1965 | Hagner . |
| 3,377,722 | 4/1968 | Downing . |
| 4,492,374 | 1/1985 | Lechtman et al. . |
| 4,534,124 | 8/1985 | Schnell . |
| 4,660,299 | 4/1987 | Omilusik . |
| 4,912,859 | 4/1990 | Ritts . |
| 5,205,798 | 4/1993 | Lekhtman . |
| 5,301,441 | 4/1994 | Kownacki . |
| 5,387,166 | 2/1995 | Gvoich . |
| 5,464,380 | 11/1995 | Ikeda et al. . |
| 5,511,324 | 4/1996 | Smith . |

FOREIGN PATENT DOCUMENTS 2084177 11/1992 Canada .

*Primary Examiner*—Lyne A. Reichard

*Attorney, Agent, or Firm*—Griffin, Butler, Whisenhunt & Kurtossy

[57] ABSTRACT

The sporting and exercising device comprises an upper foot-receiving portion, and a lower spring portion. The spring portion comprises an upper spring layer arched upwardly, a lower spring layer arched downwardly, and an intermediate elastic plastic strap. A first end of the plastic strap is connected to both a first end of the upper spring layer and a first end of the lower spring layer, and a second end of the plastic strap is connected to both a second end of the upper spring layer and a second end of the lower spring layer. First and second resilient shock absorbing bodies are mounted on the top face of the plastic strap proximate the first and second ends thereof, respectively. Similarly, third and fourth resilient shock absorbing bodies are mounted on the bottom face of the plastic strap proximate the first and second ends thereof, respectively. The resilient shock absorbing bodies prevent the spring portion to collapse after a certain deformation by compression has been reached.

8 Claims, 6 Drawing Sheets

SPORTING AND EXERCISING DEVICE HAVING A FOOT RECEIVING PORTION AND AN ANTICOLLAPSE SPRING PORTION

BACKGROUND OF THE INVENTION

1. Field of the Invention

The present invention relates to a sporting and exercising device comprising an upper foot receiving portion and a lower spring portion.

2. Brief Description of the Prior Art

U.S. Pat. No. 5,205,798 granted to Gregory Lekhtman on Apr. 27, 1993, describes a sporting and exercising device comprising a foot receiving portion and a spring portion detachably attached to the bottom face of the foot receiving portion. The spring portion comprises an upper spring layer arched upwardly, a lower spring layer arched downwardly, and an intermediate, substantially elastic plastic strap. A first end of the plastic strap is connected to both a first end of the upper spring layer and a first end of the lower spring layer. Similarly, a second end of the plastic strap is connected to both a second end of the upper spring layer and a second end of the lower spring layer.

A major drawback of the sporting and exercising device of U.S. Pat. No. 5,205,798 is that the spring portion collapses after about 7 centimeters (cm) (out of about 13 cm) of deformation by compression, that is it lacks smooth, growing elasticity. This reduces the ability to absorb increasing higher pressures, reduces the available bouncing power and makes the sporting and exercising device noisy.

OBJECTS OF THE INVENTION

The main object of the present invention is therefore to eliminate the above described drawback of the prior art.

SUMMARY OF THE INVENTION

More particularly, in accordance with the present invention, there is provided a sporting and exercising device comprising an upper foot-receiving portion, and a lower spring portion fastened to the foot-receiving portion. The spring portion comprises:

- an upper spring layer arched upwardly and comprising first and second opposite ends;
- a lower spring layer arched downwardly and comprising first and second opposite ends;
- an intermediate, substantially elastic elongate member having first and second opposite ends;
- first means for connecting the first end of the intermediate member to both the first end of the upper spring layer and the first end of the lower spring layer, and second means for connecting the second end of the intermediate member to both the second end of the upper spring layer and the second end of the lower spring layer; and
- first and second shock absorbing means mounted longitudinally remote from each other between the upper spring layer and the intermediate member, and third and fourth shock absorbing means mounted longitudinally remote from each other between the lower spring layer and the intermediate member.

The first, second, third and fourth shock absorbing means prevent the spring portion to collapse after a certain degree of deformation by compression has been reached.

In accordance with a preferred embodiment of the sporting and exercising device according to the invention, the intermediate, substantially elastic elongate member comprises a plastic strap having a top face and a bottom face.

According to another preferred embodiment:

- the first shock absorbing means comprises a first body made of resilient material and mounted on the top face of the plastic strap proximate the first ends of the upper spring layer and the plastic strap;
- the second shock absorbing means comprises a second body made of resilient material and mounted on the top face of the plastic strap proximate the second ends of the upper spring layer and the plastic strap;
- the third shock absorbing means comprises a third body made of resilient material and mounted on the bottom face of the plastic strap proximate the first ends of the lower spring layer and the plastic strap; and
- the fourth shock absorbing means comprises a fourth body made of resilient material and mounted on the bottom face of the plastic strap proximate the second ends of the lower spring layer and the plastic strap.

In accordance with a third preferred embodiment of the sporting and exercising device of the invention:

- the first, second, third and fourth bodies are generally elongate, transversal bodies;
- the first, second, third and fourth generally elongate, transversal bodies each comprise first and second opposite and generally coplanar extensions each having a free edge formed with a notch therein;
- the plastic strap comprises four pairs of spaced apart, generally angular integral tabs to mount the first, second third and fourth generally elongate transversal bodies, respectively, onto the top and bottom faces of the plastic strap;
- each tab has a first section extending from the top or bottom face of the plastic strap and a second section generally parallel to but spaced apart from the top or bottom face of the plastic strap, and extending toward the other tab of a same pair;
- the first section of the tabs has a width corresponding to a width of the notches; and
- the first extension of each generally elongate, transversal body is inserted between the second section of one tab of a corresponding pair and the top or bottom face of the plastic strap, while the second extension of the generally elongate, transversal body is inserted between the second section of the other tab of the corresponding pair and the top or bottom face of the plastic strap, until the first sections of the tabs fit into the notches of the first and second extensions of the generally elongate, transversal body, respectively.

According to a still further preferred embodiment of the sporting and exercising device:

- the plastic strap comprises a first transversal series of holes and a second transversal series of holes;
- the first and third bodies are overmolded on the top and bottom faces of the plastic strap, respectively, over the holes of the first series whereby resilient material of the first and third bodies fills the holes of the first series to interconnect the first and third bodies and retain said first and third bodies on the top and bottom faces of the plastic strap, respectively; and
- the second and fourth bodies are overmolded on the top and bottom faces of the plastic strap, respectively, over the holes of the second series whereby resilient material of the second and fourth bodies fills the holes of the second series to interconnect the second and fourth bodies and retain said second and fourth bodies on the respective top and bottom faces of the plastic strap.

Advantageously, the lower spring layer is made of a sturdy, generally flexible plastic material and comprises a bottom face, and the sporting and exercising device further comprises a sole mounted to the bottom face of the lower spring layer and formed with an antislip bottom tread.

The objects, advantages and other features of the present invention will become more apparent upon reading of the following non restrictive description of preferred embodiments thereof, given by way of example only with reference to the accompanying drawings.

DETAILED DESCRIPTION OF THE PREFERRED EMBODIMENTS

Figure 1:
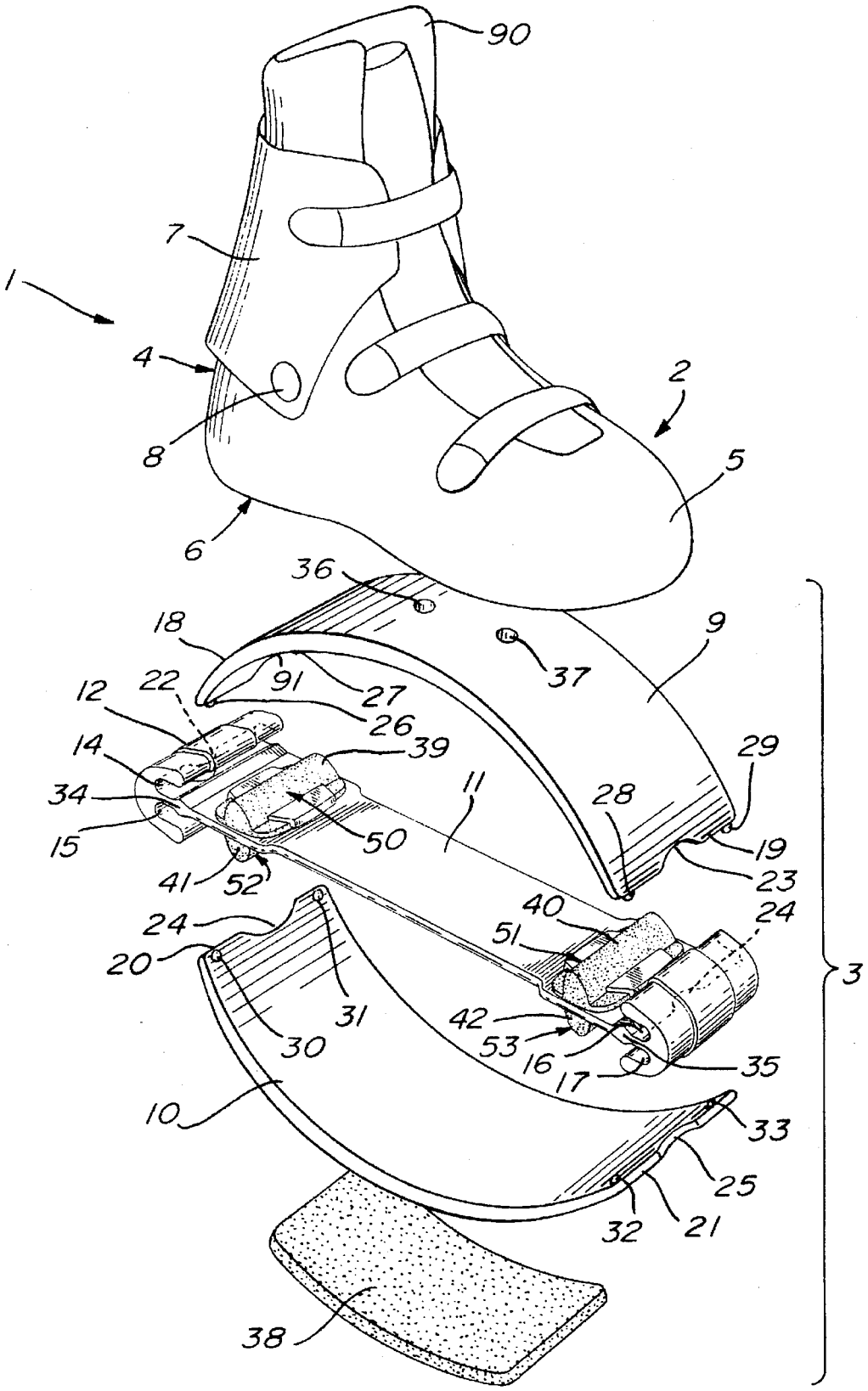
FIG. 1 is a perspective, exploded view of a sporting and exercising device in accordance with the present invention, comprising a foot-receiving portion and a spring portion.

FIG. 1 is a perspective, exploded view of a sporting and exercising device in accordance with the present invention. In FIG. 1, the sporting and exercising device is generally identified by the reference 1.

The device 1 comprises two major parts: an upper foot receiving portion 2 and a lower spring portion 3.

Preferably, the foot receiving portion 2 is formed of a boot 4. The boot 4 comprises a lower shell 5 with a bottom 6, and an upper shell 7 hingedly connected to the lower shell 5 through a pair of fasteners of which one 8 is shown. The lower 5 and upper 7 shells are made of molded plastic material. The boot 4 further includes a padded inner boot 90 inserted in the hingedly interconnected shells 5 and 7. This type of boot, currently used in the fabrication of ice skates, is well known to those of ordinary skill in the art and accordingly will not be further described.

It should be kept in mind that it is within the scope of the present invention to use in the sporting and exercising device foot receiving portions having a structure different from that of FIG. 1.

The spring portion 3 comprises an upper spring layer 9, a lower spring layer 10, and an intermediate spring rate and weight adjusting elongate plastic strap 11.

The upper spring layer 9 is arched upwardly and the lower spring layer 10 is arched downwardly as illustrated in FIG. 1. Both the upper and lower spring layers 9 and 10 are made of a sturdy, generally flexible plastic material.

The strap 11 is made of a substantially elastic plastic material and is interposed between the upper and lower spring layers 9 and 10. To increase the spring resistance and/or to support a greater weight, the cross sectional area of the plastic strap 11 is increased. Alternatively, to reduce the spring resistance and/or to support a smaller weight, the cross sectional area of the plastic strap 11 is reduced.

The plastic strap 11 has a first end provided with a generally arrow-shaped integral connecting member 12, and a second end opposite to the first end and provided with a generally arrow-shaped integral connecting member 13. The arrow-shaped connecting member 12 is formed with transversal rear grooves 14 and 15 situated on the opposite top and bottom faces of the plastic strap 11, respectively. Similarly, the arrow-shaped connecting member 13 is formed with transversal rear grooves 16 and 17 situated on the opposite top and bottom faces of the plastic strap 11.

To assemble the upper spring layer 9, the lower spring layer 10, and the intermediate plastic strap 11 together and thereby form the spring portion 3, the upper spring layer 9 is bent to insert its two opposite ends 18 and 19 into the grooves 14 and 16, respectively, and the lower spring layer 10 is also bent to insert its two opposite ends 20 and 21 into the grooves 15 and 17, respectively. The plastic strap 11 is then tensioned and stretched by the spring action produced by the resiliency of the arched upper and lower spring layers 9 and 10.

The end 18 of the upper spring layer 9 comprises an indent 91 fitted into a corresponding indent 22 of the groove 14. In the same manner, the end 19 of the upper spring layer 9 comprises an indent 23 fitted into a corresponding indent 24 of the groove 16. The end 20 of the lower spring layer 10 also comprises an indent 24 fitted into a corresponding indent (not shown) of the groove 15. Finally, the end 21 of the lower spring layer 10 comprises an indent 25 fitted into a corresponding indent (not shown) of the groove 17. When the spring portion 3 is assembled as described hereinabove, the arrow-shaped connecting member 12 connects one end of the plastic strap 11 with the ends 18 and 20 of the upper and lower spring layers 9 and 10, while the arrow-shaped connecting member 13 connects the other end of the plastic strap 11 with the ends 19 and 21 of the upper and lower spring layers 9 and 10.

The mutually mating indents will of course prevent lateral movement of the ends 18, 19, 20 and 21 in the grooves 14, 16, 15 and 17, respectively, to thereby hold the ends 18, 19, 20 and 21 in the grooves 14, 16, 15 and 17, respectively.

As described in U.S. Pat. No. 5,205,798, nipples 26 and 27 may extend from the bottom face of the upper spring layer 9 at the end 18 thereof. Similarly, nipples 28 and 29 may extend from the bottom face of the upper spring layer 9 at the end 19 thereof, nipples 30 and 31 may extend from the top face of the lower spring layer 10 at the end 20 thereof, and nipples 32 and 33 may extend from the top face of the lower spring layer 10 at the end 21 thereof. When the spring portion 3 is assembled, the nipples 26–33 will abut respective edge surfaces such as 34 and 35 of the generally arrow-shaped connecting members 12 and 13 to help in holding the ends 18, 19, 20 and 21 in the grooves 14, 16, 15 and 17, respectively.

The spring portion 3 is mounted onto the boot 4 by detachably fastening the upper spring layer 9 to the bottom 6 of the lower shell 5 by means, for example, of appropriate screw fasteners (not shown) passing through openings 36 and 37 of the upper spring layer 9 and corresponding openings (not shown) in the bottom 6 of the lower shell 5 of the boot 4.

Finally, a sole 38 is screwed to the bottom face of the lower spring layer 10. The sole 38 has an anti-slip bottom tread to prevent accidents caused by slipping of the device 1 on the ground.

In operation, the nipples 26–33 will abut the respective edge surfaces such as 34 and 35 of the generally arrow-shaped connecting members 12 and 13 to prevent lateral movement of the ends 18, 19, 20 and 21 in the grooves 14, 16, 15 and 17, respectively, when a small lateral force is applied. When a strong lateral force is applied, this strong force will overcome the restraint of the nipples 26–33 and will withdraw the indents of the ends 18 and 19 of the upper spring layer 9 and the ends 20 and 21 of the lower spring layer 10 from the indents of the grooves 14, 16, 15 and 17, respectively, to automatically disassemble the spring portion 3 and prevent the user to fall, and to twist and/or sprain his ankles. Upon disassembly of the spring portion 3, the user will step onto the bottom face of the upper spring layer 9.

Figure 2:
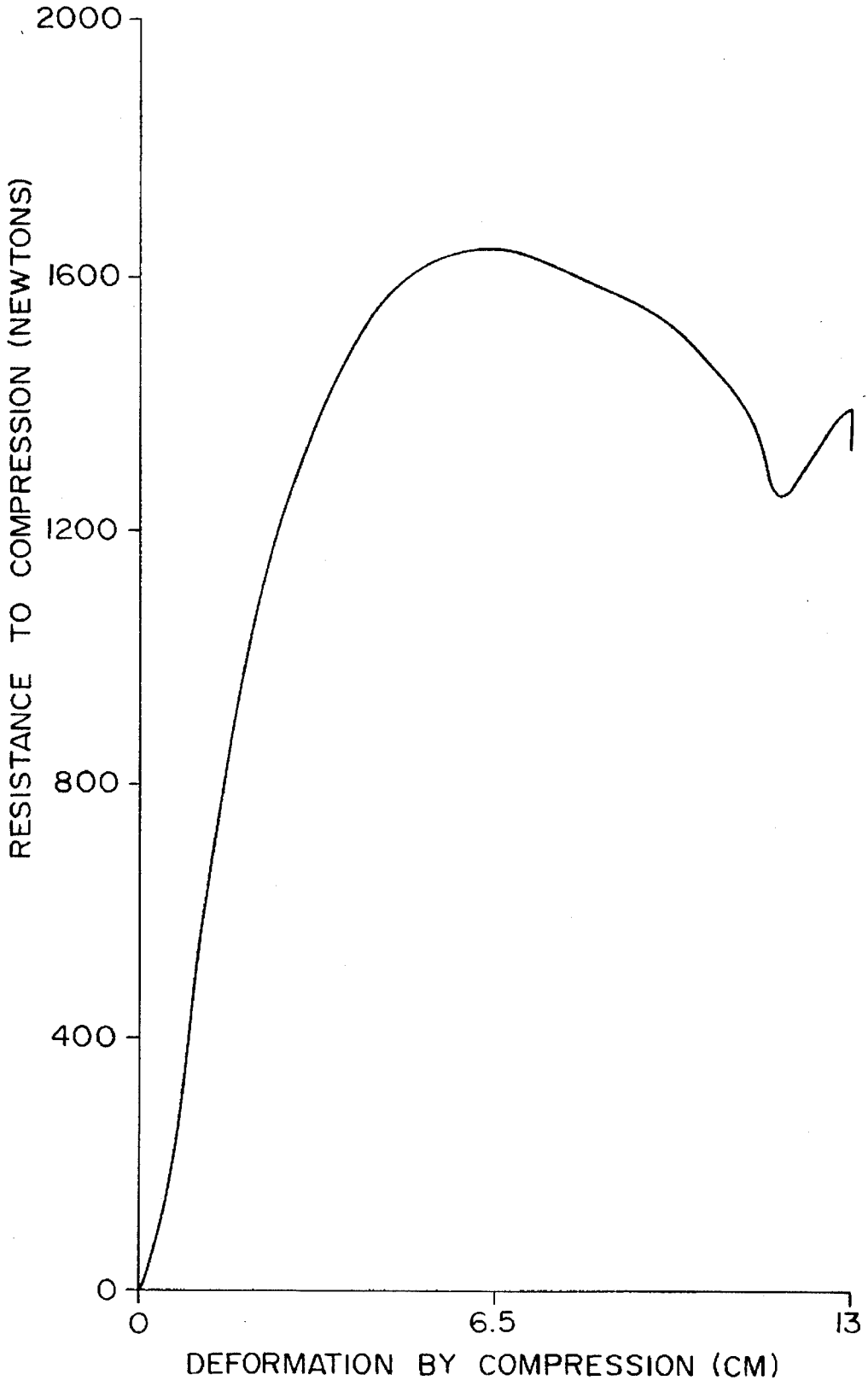
FIG. 2 (PRIOR ART)
FIG. 2, which is labelled as prior art, is a graph illustrating the evolution of the resistance (force in Newtons) of the spring portion to compression as a function of the deformation (cm) by compression of a sporting and exercising device as described in U.S. Pat. No. 5,205,798.

FIG. 2 is a graph illustrating the evolution of the resistance (force in Newtons) of the spring portion 3 to compression as a function of the deformation (cm) by compression of a sporting and exercising device as described in U.S. Pat. No. 5,205,798, having a plastic band 11 60 cm wide.

As can be seen in FIG. 2, the maximal resistance of the spring portion 3 is found at about 7 cm of deformation by compression. From this point, the resistance of the spring portion 3 gradually reduces as the deformation by compression increases.

As the spring portion 3 collapses at 7 cm (out of about 13 cm) of deformation by compression, the spring portion 3 lacks smooth, growing elasticity. This reduces the ability of the sporting and exercising device to absorb increasing higher pressures. This also reduces the available bouncing power and makes the sporting and exercising device noisy.

To overcome the above drawback of the sporting and exercising device of U.S. Pat. No. 5,205,798, the spring portion 3 of the present invention is provided with shock absorbing means 50–53.

Figure 3:
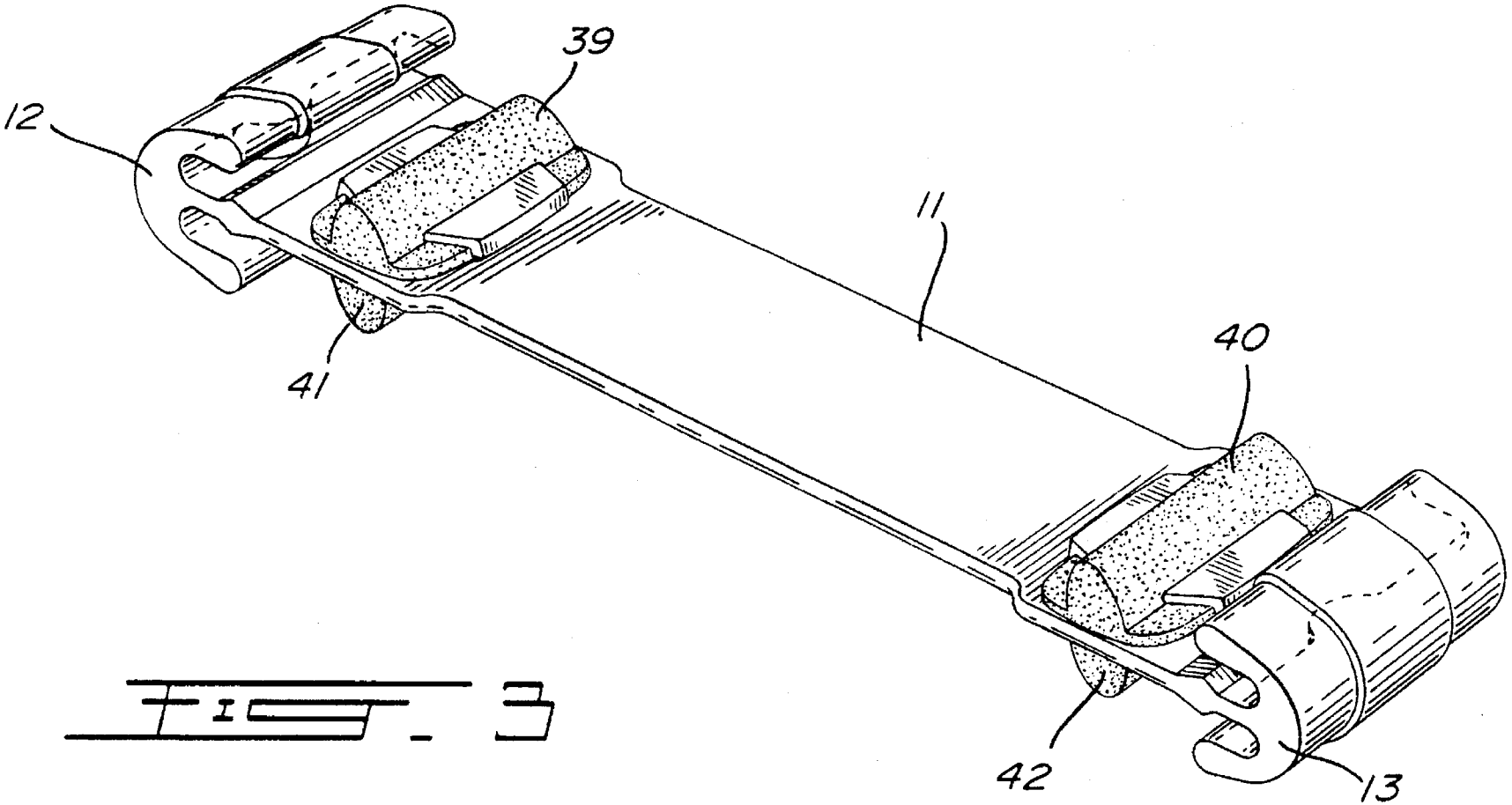
FIG. 3 is a perspective, enlarged view of a generally elastic plastic strap of the spring portion of the device of FIG. 1, comprising resilient shock absorbing bodies.

Preferably, these shock absorbing means 50–53 comprise four bodies of resilient material such as rubber material and resilient foam material. As illustrated in FIGS. 1 and 3:

the shock absorbing means 50 comprises a first elongate transversal resilient shock absorbing body 39 mounted on the top face of the plastic strap 11 proximate a first end thereof and the end 18 of the upper spring layer 9;

the shock absorbing means 51 comprises a second elongate transversal resilient shock absorbing body 40 mounted on the top face of the plastic strap 11 proximate a second end thereof and the end 19 of the upper spring layer 9;

the shock absorbing means 52 comprises a third elongate transversal resilient shock absorbing body 41 mounted on the bottom face of the plastic strap 11 opposite to the body 39, i.e. proximate the first end of the plastic strap 11 and the end 20 of the lower spring layer; and the shock absorbing means 53 comprises a fourth elongate transversal resilient shock absorbing body 42 mounted on the bottom face of the plastic strap 11 opposite to the body 40, i.e. proximate the second end of the plastic strap 11 and the end 21 of the lower spring layer 10.

As illustrated in FIGS. 1 and 3, the shock absorbing bodies 39 and 40 are mounted longitudinally remote from each other between the upper spring layer 9 and the plastic strap 11. Similarly, the shock absorbing bodies 41 and 42 are mounted longitudinally remote from each other between the lower spring layer 10 and the plastic strap 11. The bodies 39–42 are generally semi-elliptical in cross section and have rounded ends. They can be made of resilient rubber material or resilient foam material such as polyurethane or other plastics.

Figure 4:
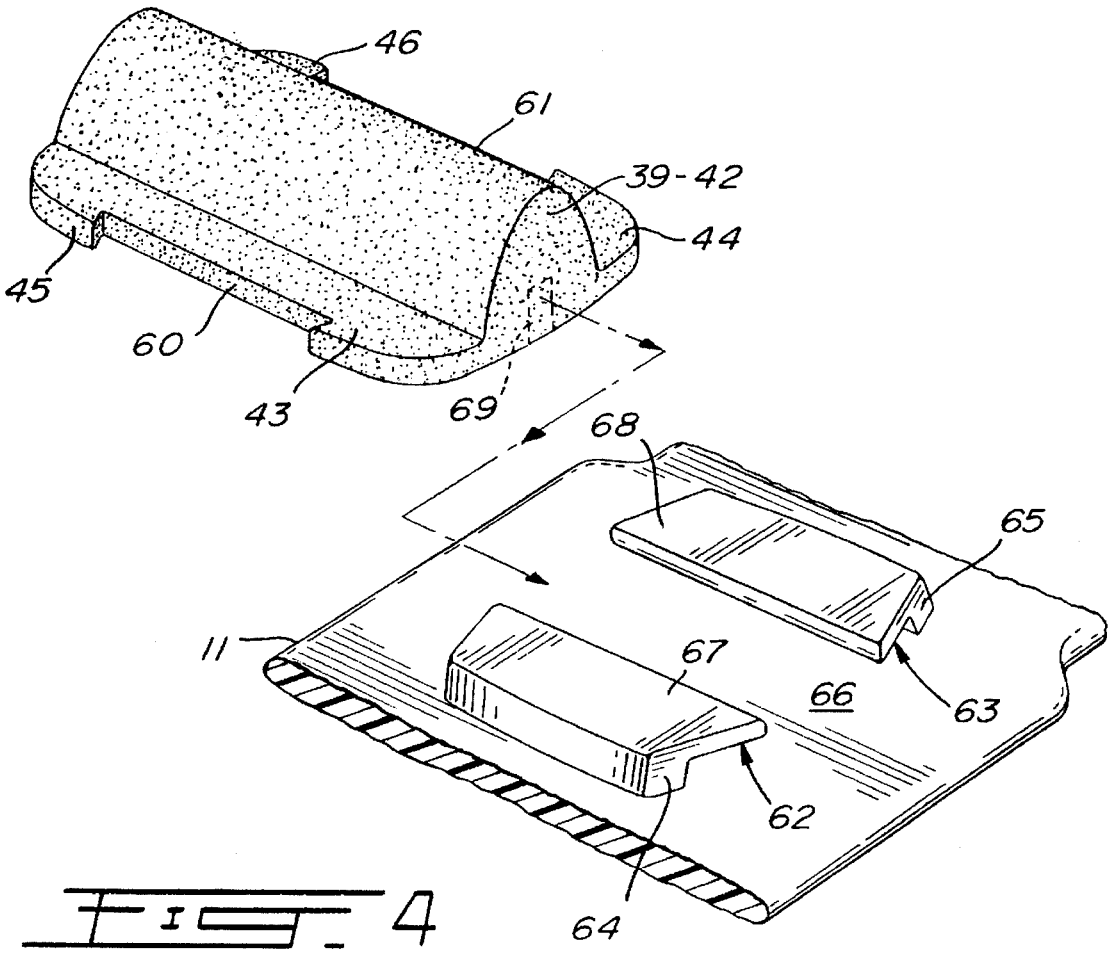
FIG. 4 is a schematic diagram illustrating a first method of mounting the resilient shock absorbing bodies onto the plastic strap of FIG. 3.
Figure 5:
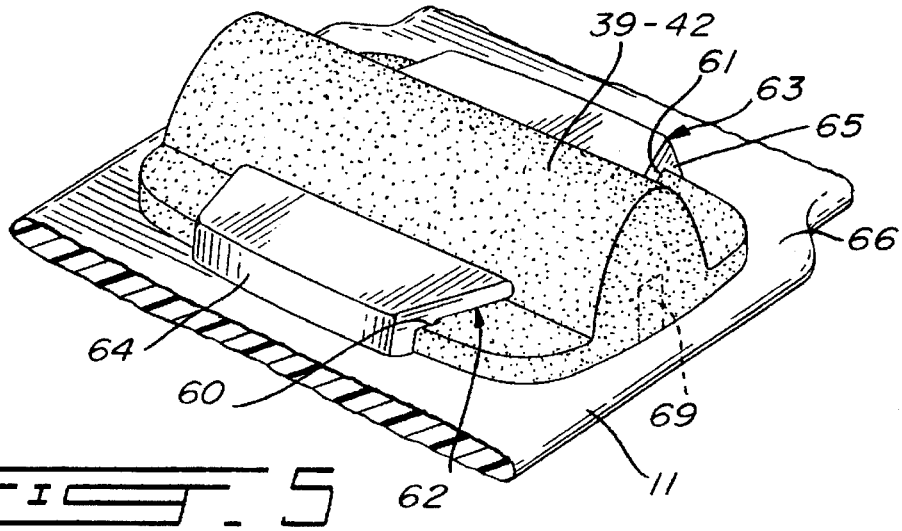
FIG. 5 is a perspective, partial view of the plastic strap of FIG. 3, with a resilient shock absorbing body mounted thereon in accordance with the first method.

FIGS. 4 and 5 illustrate a first method of mounting the resilient bodies 39–42 onto the plastic strap 11. According to this first method, each body 39–42 comprises two opposite and generally coplanar extensions 43 and 44 having respective free edge 45 and 46 formed with notches 60 and 61 therein. The plastic strap 11 comprises four pairs of spaced apart, generally angular integral tabs such as 62 and 63 for mounting the bodies 39–42, respectively, onto the top and bottom faces of the plastic strap 11.

Each tab 62,63 has a first section 64,65 extending generally perpendicular from the top or bottom face 66 of the plastic strap 11 and a second section 67,68 generally parallel to but spaced apart from the top or bottom face 66 of the plastic strap 11, and extending toward the other tab 63,62 of the same pair.

The first sections 62 and 63 of the tabs 63 and 62 have a width corresponding to a width of the notches 60 and 61 whereby, in operation, the extension 43 of each body 39–42 is inserted between the second section 67 of the tab 62 of a corresponding pair and the top or bottom face 66 of the plastic strap 11, while the extension 44 of the body 39–42 is inserted between the second section 68 of the other tab 63 of said corresponding pair and the top or bottom face 66 of the plastic strap 11, until the first sections 64 and 65 of the tabs 62 and 63 fit into the notches 60 and 61 of the extensions 43 and 44 of the body 39–42.

It should be noted that the bodies 39–42 may be formed with a bottom longitudinal groove such as 69 (FIGS. 4 and 5) to increase, or more generally adjust their flexibility.

Figure 6:
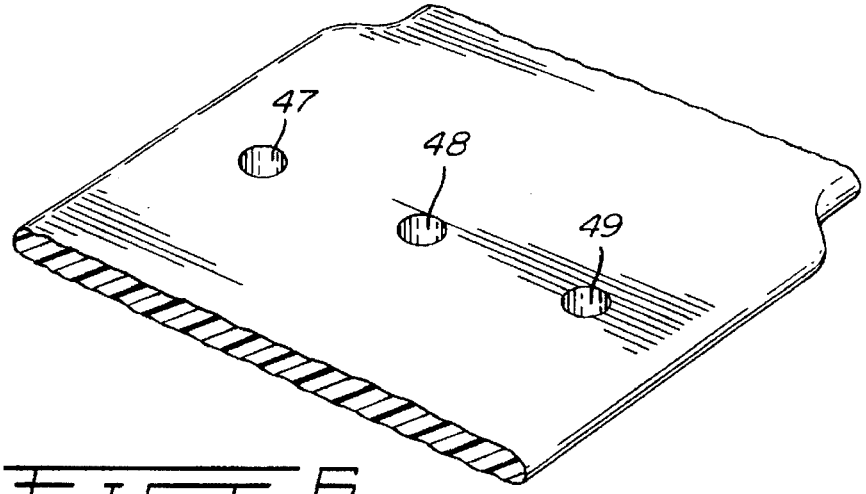
FIG. 6 illustrates a transversal series of holes made in the plastic strap for mounting the shock absorbing bodies in accordance with a second method (overmolding)
Figure 7:
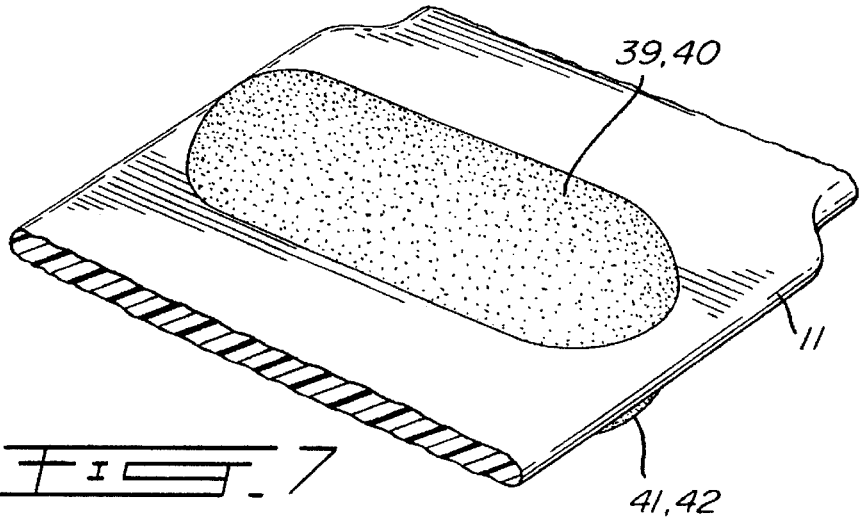
FIG. 7 is a perspective, partial view of the plastic strap with shock absorbing bodies mounted thereon in accordance with the second method.

In accordance with another method as illustrated in FIGS. 5, 6 and 7, a transversal series of three holes 47, 48 and 49 are made through the plastic strap 11 (FIG. 5) and the pair of opposite resilient bodies 39 and 41 are simultaneously overmolded on the opposite top and bottom faces of the strap 11 (FIG. 7). Resilient material of the bodies 39 and 41 fill the holes 47–49 (FIG. 8) to interconnect the bodies 39 and 41 and retain the latter bodies on the corresponding top and bottom faces of the strap 11. Those of ordinary skill in the art will appreciate that the insertion of the first sections 64 and 65 of the tabs 62 and 63 in the notches 60 and 61 prevents the extensions 43 and 44 to slide out of the tabs 62 and 63.

The same method is used to produce and simultaneously install the resilient bodies 41 and 42.

Figure 8:
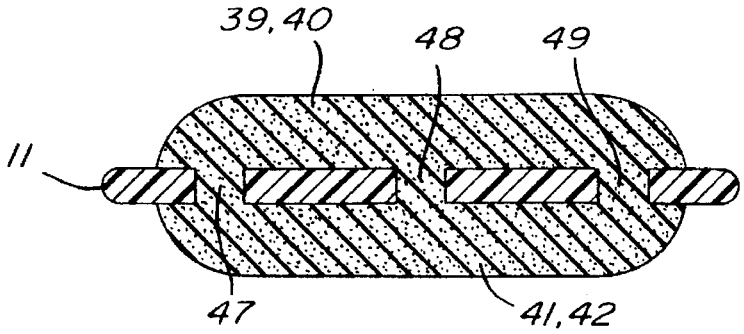
FIG. 8 is an elevational transversal cross sectional view of the plastic strap with shock absorbing bodies mounted thereon in accordance with the second method.

In the embodiment of FIGS. 6–8, the bodies 39–42 are generally semicylindrical with rounded ends.

When the deformation by compression of the spring portion 3 reaches 7 cm, the bottom face of the upper spring layer 9 is applied to the shock absorbing bodies 39 and 40 while the top face of the lower spring layer 10 is applied to the shock absorbing bodies 41 and 42. At this moment:

(a) the resilient shock absorbing bodies 39–42 progressively absorbs compression forces and corresponding energy is accumulated and stored in the resilient bodies 39–42 and is subsequently released to increase the bouncing power of the sporting and exercising device;

(b) each shock absorbing body (for example shock absorbing body 39) create a progressively increasing lever force on the end section of the corresponding spring layer (for example spring layer 9) between the shock absorbing body (for example shock absorbing body 39) and the corresponding connecting member (for example arrow-shaped connecting member 12) whereby the flexibility of this end section contributes to increase the resistance to compression of the spring portion 3; and (c) starting from a certain degree of compression of the shock absorbing bodies 39–42, the span of the two spring layers 9 and 10 is reduced to the distance separating the two shock absorbing bodies 39 and 40; 41 and 42, respectively, whereby the rigidity of the spring layers increases to increase the resistance to compression of these spring layers.

The above described structure including the shock absorbing bodies 39–42 presents, amongst others, the following advantages:

increased bouncing power of the device;

improved comfort for the user;

increased flexibility of the sporting and exercising device (wider range of resistance to compression);

improved protection of the user's joints by a better absorption of the impacts and by an increased impact time;

the sporting and exercising device is more quiet whereby it can also be used indoors, for example in fitness classes; and more personalized weight and stiffness/softness adjustments of the sporting and exercising device are enabled for each user by changing the dimensions and hardness of the resilient shock absorbing bodies 39–42.

Figure 9:
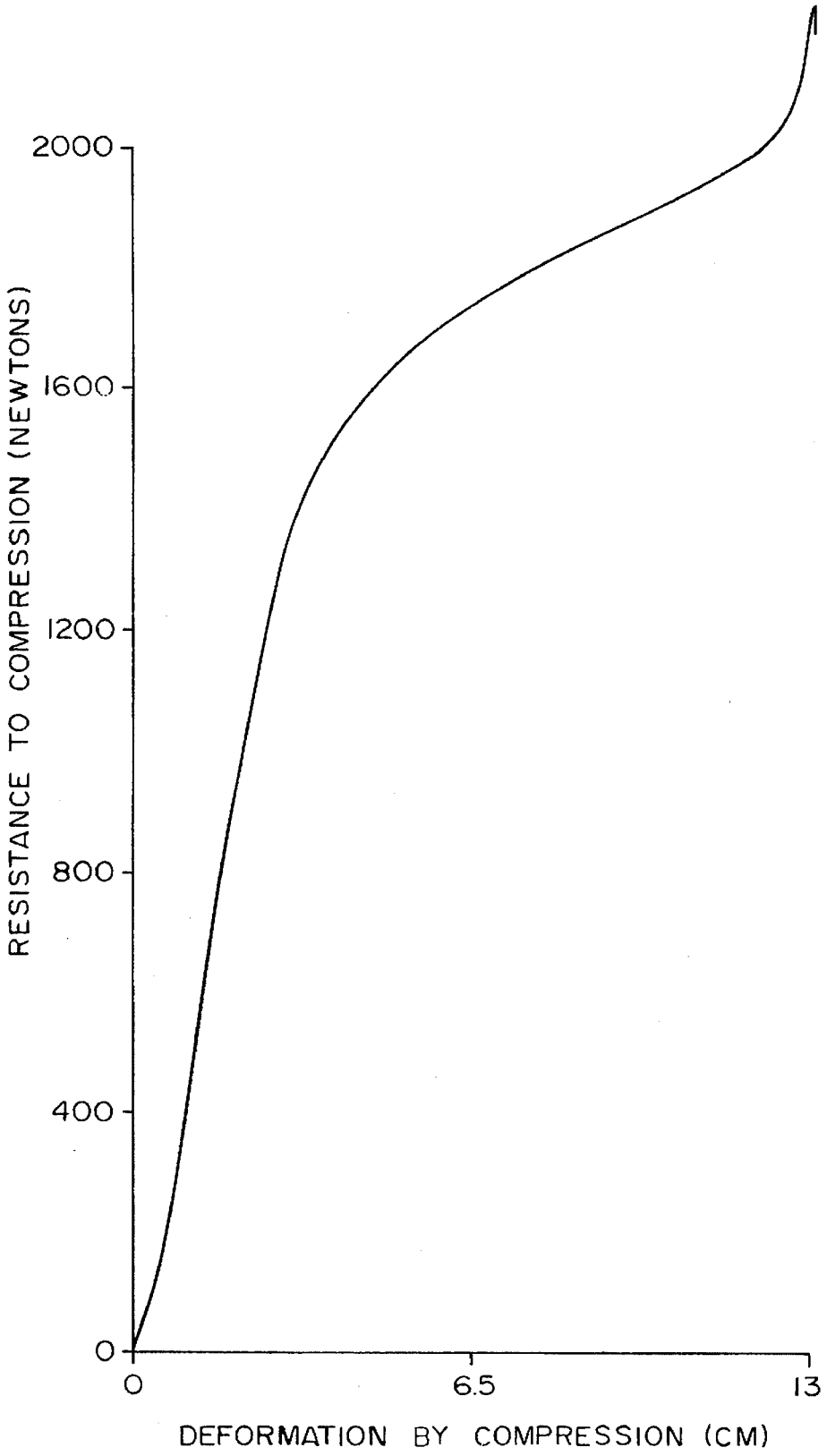
FIG. 9 is a graph illustrating the evolution of the resistance (force in Newtons) of the spring portion to compression as a function of the deformation (cm) by compression of a sporting and exercising device in accordance with the present invention.

Finally, FIG. 9 shows that the resistance (force in Newtons) of the spring portion 3 to compression continues to increase after the threshold of 7 cm of deformation by compression has been reached. Generally speaking, the present invention therefore eliminates the major drawback of a spring portion that collapses as soon as a deformation by compression of about 7 cm has been reached.

Although the present invention has been described hereinabove with reference to preferred embodiments thereof, these embodiments can be modified at will, within the scope of the appended claims, without departing from the spirit and nature of the subject invention.

What is claimed is:

1. A sporting and exercising device comprising an upper foot-receiving portion, and a lower spring portion fastened to the foot-receiving portion, the spring portion comprising:

an upper spring layer arched upwardly and comprising first and second opposite ends;

a lower spring layer arched downwardly and comprising first and second opposite ends;

an intermediate, substantially elastic elongate member having first and second opposite ends;

first means for connecting the first end of the intermediate member to both the first end of the upper spring layer and the first end of the lower spring layer, and second means for connecting the second end of the intermediate member to both the second end of the upper spring layer and the second end of the lower spring layer; and first and second shock absorbing means mounted longitudinally remote from each other between the upper spring layer and the intermediate member, and third and fourth shock absorbing means mounted longitudinally remote from each other between the lower spring layer and the intermediate member.

2. A sporting and exercising device as recited in claim 1, in which the first shock absorbing means is situated proximate the first ends of the upper spring layer and the intermediate member, the second shock absorbing means is situated proximate the second ends of the upper spring layer and the intermediate member, the third shock absorbing means is situated proximate the first ends of the lower spring layer and the intermediate member, and the fourth shock absorbing means is situated proximate the second ends of the lower spring layer and the intermediate member.

3. A sporting and exercising device as recited in claim 1, in which the intermediate, substantially elastic elongate member comprises a plastic strap having a top face and a bottom face.

4. A sporting and exercising device as recited in claim 3, in which:

the first shock absorbing means comprises a first body made of resilient material and mounted on the top face of the plastic strap proximate the first ends of the upper spring layer and the plastic strap;

the second shock absorbing means comprises a second body made of resilient material and mounted on the top face of the plastic strap proximate the second ends of the upper spring layer and the plastic strap;

the third shock absorbing means comprises a third body made of resilient material and mounted on the bottom face of the plastic strap proximate the first ends of the lower spring layer and the plastic strap; and the fourth shock absorbing means comprises a fourth body made of resilient material and mounted on the bottom face of the plastic strap proximate the second ends of the lower spring layer and the plastic strap.

5. A sporting and exercising device as recited in claim 4, in which the first, second, third and fourth bodies are generally elongate, transversal bodies.

6. A sporting and exercising device as recited in claim 5, wherein:

each of said first, second, third and fourth generally elongate, transversal bodies comprise first and second opposite and generally coplanar extensions each having a free edge formed with a notch therein; and the plastic strap comprises four pairs of spaced apart, generally angular integral tabs to mount the first, second third and fourth generally elongate transversal bodies, respectively, onto the top and bottom faces of the plastic strap; wherein:

each tab has a first section extending from the top or bottom face of the plastic strap and a second section generally parallel to but spaced apart from the top or bottom face of the plastic strap, and extending toward the other tab of a same pair;

the first section of said tabs has a width corresponding to a width of said notches;

whereby, in operation, the first extension of each generally elongate, transversal body is inserted between the second section of one tab of a corresponding pair and the top or bottom face of the plastic strap, while the second extension of said generally elongate, transversal body is inserted between the second section of the other tab of said corresponding pair and the top or bottom face of the plastic strap, until the first sections of the tabs fit into the notches of the first and second extensions of said generally elongate, transversal body, respectively.

7. A sporting and exercising device as recited in claim 4, wherein:

the plastic strap comprises a first transversal series of holes and a second transversal series of holes;

the first and third bodies are overmolded on the top and bottom faces of the plastic strap, respectively, over the holes of the first series whereby resilient material of the first and third bodies fills the holes of the first series to interconnect the first and third bodies and retain said first and third bodies on the top and bottom faces of the plastic strap, respectively; and the second and fourth bodies are overmolded on the top and bottom faces of the plastic strap, respectively, over the holes of the second series whereby resilient material of the second and fourth bodies fills the holes of the second series to interconnect the second and fourth bodies and retain said second and fourth bodies on the top and bottom faces of the plastic strap, respectively.

8. A sporting and exercising device as recited in claim 1, wherein:

the lower spring layer is made of a sturdy, generally flexible plastic material and comprises a bottom face; and the sporting and exercising device further comprises a sole mounted to the bottom face of the lower spring layer and formed with an anti-slip bottom tread.

* * * * *